US007865986B2

(12) United States Patent
Smart

(10) Patent No.: US 7,865,986 B2
(45) Date of Patent: Jan. 11, 2011

(54) FIELD STRETCHER

(75) Inventor: Colin Smart, Leeds (GB)

(73) Assignee: TSG Associates LLP, Pellon Halifax, West Yorkshire (GB)

( * ) Notice: Subject to any disclaimer, the term of this patent is extended or adjusted under 35 U.S.C. 154(b) by 0 days.

(21) Appl. No.: 12/512,672

(22) Filed: Jul. 30, 2009

(65) Prior Publication Data

US 2010/0024129 A1 Feb. 4, 2010

Related U.S. Application Data

(60) Provisional application No. 61/084,746, filed on Jul. 30, 2008.

(51) Int. Cl.
*A61G 1/013* (2006.01)

(52) U.S. Cl. ..... 5/625; 5/627; 5/628; 5/81.1 HS; 294/140

(58) Field of Classification Search ..... 5/625–628, 5/81.1 HS; 294/140
See application file for complete search history.

(56) References Cited

U.S. PATENT DOCUMENTS

| | | | | |
|---|---|---|---|---|
| 4,064,574 | A | 12/1977 | Schnitzler | |
| 4,442,557 | A * | 4/1984 | Clemens | 5/625 |
| 4,922,562 | A | 5/1990 | Allred et al. | |
| 5,189,746 | A | 3/1993 | Horie | |
| 5,317,770 | A | 6/1994 | Sakurai | |
| 5,386,604 | A | 2/1995 | Ricketts | |
| 5,398,358 | A | 3/1995 | Mercke et al. | |
| 5,442,821 | A * | 8/1995 | Weeks | 5/89.1 |
| 5,539,945 | A | 7/1996 | Rosenberg et al. | |
| 5,598,592 | A | 2/1997 | Castellani | |
| 5,787,529 | A | 8/1998 | Landes | |
| 5,839,137 | A * | 11/1998 | Butler et al. | 5/627 |
| 5,978,989 | A | 11/1999 | Chavez | |
| 6,427,271 | B1 * | 8/2002 | Gadzia et al. | 5/627 |
| 6,440,160 | B1 | 8/2002 | Cordani et al. | |
| 6,634,044 | B1 | 10/2003 | Wright | |
| 6,823,542 | B2 | 11/2004 | Berge | |
| 6,871,368 | B2 | 3/2005 | Calkin | |
| 7,043,785 | B2 | 5/2006 | Dimentmen | |
| 7,467,419 | B2 | 12/2008 | O'Neal et al. | |
| 2003/0000017 | A1 * | 1/2003 | Byerrum et al. | 5/625 |
| 2003/0106155 | A1 | 6/2003 | Arai | |
| 2004/0088794 | A1 | 5/2004 | Calkin | |
| 2006/0137097 | A1 | 6/2006 | Frost | |
| 2007/0136950 | A1 | 6/2007 | Zuercher | |
| 2007/0163047 | A1 | 7/2007 | Noonchester | |
| 2007/0199148 | A1 | 8/2007 | Ricketts | |
| 2008/0184488 | A1 | 8/2008 | Fee et al. | |
| 2009/0038076 | A1 * | 2/2009 | Giduck | 5/627 |

* cited by examiner

*Primary Examiner*—Michael Trettel
(74) *Attorney, Agent, or Firm*—Christopher J. Knors; Moore & Van Allen PLLC

(57) ABSTRACT

A field stretcher comprising a subject transporting portion, the subject transporting portion comprising a region capable of forming a subject retaining compartment for retaining a subject positioned within the subject transporting portion, is disclosed and described. A method of transporting a subject generally horizontally, is provided, the method comprising providing a field stretcher comprising a subject transporting portion, positioning a subject in the subject transporting portion, and drawing at least a portion of the subject transporting portion about at least a portion of the subject.

18 Claims, 9 Drawing Sheets

FIELD STRETCHER

CROSS-REFERENCE TO RELATED APPLICATIONS

This application claims benefit of priority under 35 U.S.C. §119(e) to the filing date of U.S. Provisional Application 61/084,746, filed on Jul. 30, 2008, which is incorporated herein by reference in its entirety.

TECHNICAL FIELD

The present invention relates to field stretchers, particularly for recovering wounded soldiers from field.

BACKGROUND

Field stretchers are known in the art and are used for transporting wounded individuals in the field. They differ from medical stretchers used in medical facilities in that they are designed to be lightweight and compact, enabling the field stretcher to be carried about an individual person and a casualty to be moved by a single person.

Known field stretchers comprise a simple piece of fabric material upon which an injured person may be placed, then the stretcher dragged to a position of safety. Problems with this type of known stretcher exist in that a wounded individual may roll off the stretcher during transport. Also, in many instances, such stretchers are used to recover soldiers or other casualties from mine fields, having been wounded by a land mine. Often in such cases, the causality's legs may have been severely injured or removed, and as such, may have a significantly reduced body length. In such scenarios, known field stretchers are inappropriate since they are too large and again promote the incidence of subjects rolling off the stretcher. The inappropriate length of the know field stretchers in these situations dictates that carry handles are not in the optimum place for safe subject transport.

SUMMARY

It is an object of aspects of the present invention to provide a solution to the above mentioned or other problems.

According to a first embodiment, there is provided a field stretcher comprising a subject transporting portion, the subject transporting portion comprising a region capable of forming a subject retaining compartment for retaining a subject positioned within the subject transporting portion.

In one aspect of the first embodiment, the field stretcher further comprises one or more handles positioned about the subject transporting portion operable for dragging the stretcher along a surface.

In another aspect of the first embodiment, the subject transporting portion has a lower region and preferably an upper region. Preferably, the lower region generally corresponds to a position of a lower portion of a subject's body, in use. Preferably, the upper region generally corresponds to a position of an upper portion of a subject's body, in use.

In another aspect of the first embodiment, the subject transporting portion is generally elongate and is preferably generally coffin shaped in plan. Preferably, the subject transporting portion comprises one or more handles at or toward an upper end thereof, preferably being the longitudinal terminus of the upper region.

In another aspect of the first embodiment, the subject transporting portion comprises one or more handles along sides thereof. Preferably, the handles are arranged in pairs, preferably at opposing sides of the subject transporting portion.

In another aspect of the first embodiment, the stretcher further comprises a retaining region forming a part of the subject retaining compartment.

In another aspect of the first embodiment, the retaining region may be drawn together with the lower region of the subject transporting portion.

In another aspect of the first embodiment, the subject transporting portion may comprise drawing means operable to draw a portion, preferably a portion of the perimeter, of the subject transporting portion. In this manner, a subject retaining compartment may be formed adapted to the particular subject in need of transport. The drawing means may extend around a portion of the perimeter of the subject transporting portion and may extend around a portion of the perimeter of the retaining region. An example of perimeter shortening means is a drawstring. The field stretcher may comprise a drawstring operable to draw the subject transporting portion, thereby forming the subject retaining compartment. The drawstring may extend around a portion of an edge of the subject transporting portion. The drawstring may extend around a portion of the retaining region.

In another aspect of the first embodiment, the subject transporting portion may comprise a dual skin, which may have an access therein defining retaining means between the skins. The access may be situated toward an upper region of the subject transporting portion and may be a lateral slit, that is, generally perpendicular to a longitudinal axis of the stretcher. A pad, support, or heat source may be placed between the two skins of the dual skinned subject transporting portion. The subject transporting portion may comprise a manipulation slit therein, which may allow a user to pull the pad, support, or heat source into the stretcher body. The manipulation slit may be situated toward a lower end of the stretcher and may be parallel with a longitudinal axis of the stretcher.

In another aspect of the first embodiment, the drawstring may be provided with a toggle to preferably allow the drawstring to be retained in a predetermined drawn position.

In another aspect of the first embodiment, at least a portion of the subject transporting portion is formed from a fabric material, preferably an abrasion resistant fabric material. The fabric material may be natural or synthetic. The fabric material may be knitted or woven. An example of a suitable material is Cordura® commercially available from Invista. The fabric material may contain or be coated with an abrasion resistant agent, anti-static agent, a flame-retardant agent, or combinations thereof.

In a second embodiment, a method of transporting a subject generally horizontally, is provided. The method comprises providing a field stretcher comprising a subject transporting portion, positioning a subject in the subject transporting portion, and drawing at least a portion of the subject transporting portion about at least a portion of the subject.

All of the features contained herein may be combined with any of the above aspects and in any combination.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION

Figure 1:
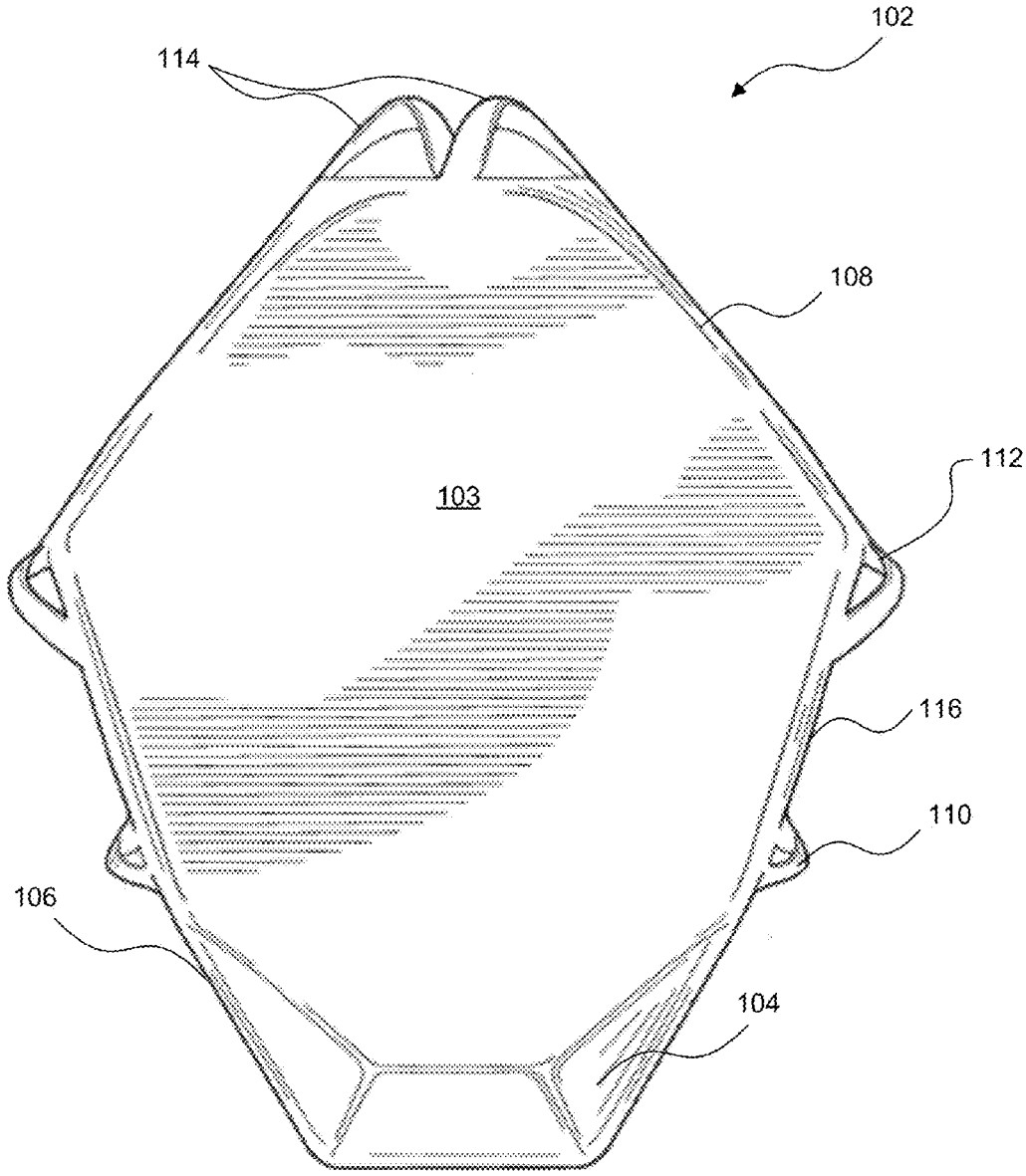
FIG. 1 shows a prospective view of a field stretcher embodiment of the present invention, showing the bottom surface thereof.

The various aspects of the field stretcher disclosed and described herein are provided for the removal of injured or incapacitated individuals, making it possible to move, or generally horizontally slide, the individual from one place to another. In addition, the various aspects of the field stretcher configuration provide for the containment of individuals who are otherwise likely to roll or slide off a conventional stretcher due to the partial or total loss of one or both lower body appendages.

Referring to FIGS. 1-4 there is provided a field stretcher 102 having a subject transporting portion 104. The stretcher may preferably be in the form of a dual skinned fabric material in a general sheet form that may be stitched together at predetermined positions about the form. The subject transporting portion is depicted as generally coffin shaped in plan, for example, being an irregular hexagon, to contour the general shape of a human body. In this manner, the subject transporting portion is generally elongate and comprises a lower region 106, where a lower part of a subject's body would typically be situated in use, and an upper region 108 where an upper part of a subject's body would typically be situated, in use.

Pairs of handles 110, 112 and 114 are situated at edges of the stretcher 102. A first pair of handles 110 is situated at either side of the subject transporting portion 104 adjacent the lower region 106 thereof. A second pair of handles 112 is situated at either side of the subject transporting portion 104 at the widest part thereof (corresponding generally to the proximity of a subjects shoulders), and a third pair of handles 114 are situated at an upper end of the subject transporting portion 104, for example, above or in proximity to a subject's head, when in use. The stretcher may be configured of a dual skin of material comprising an upper skin and lower skin. In this configuration the material may be configured to provide one or more compartments at predetermined positions about the stretcher. Toward the upper region 108 is at least one optional lateral slit 121 in an upper skin of an optional dual skin subject transporting portion and toward the lower region 106 is at least one optional longitudinal slit 123 in the upper skin of the subject transporting portion 104.

Figure 2:
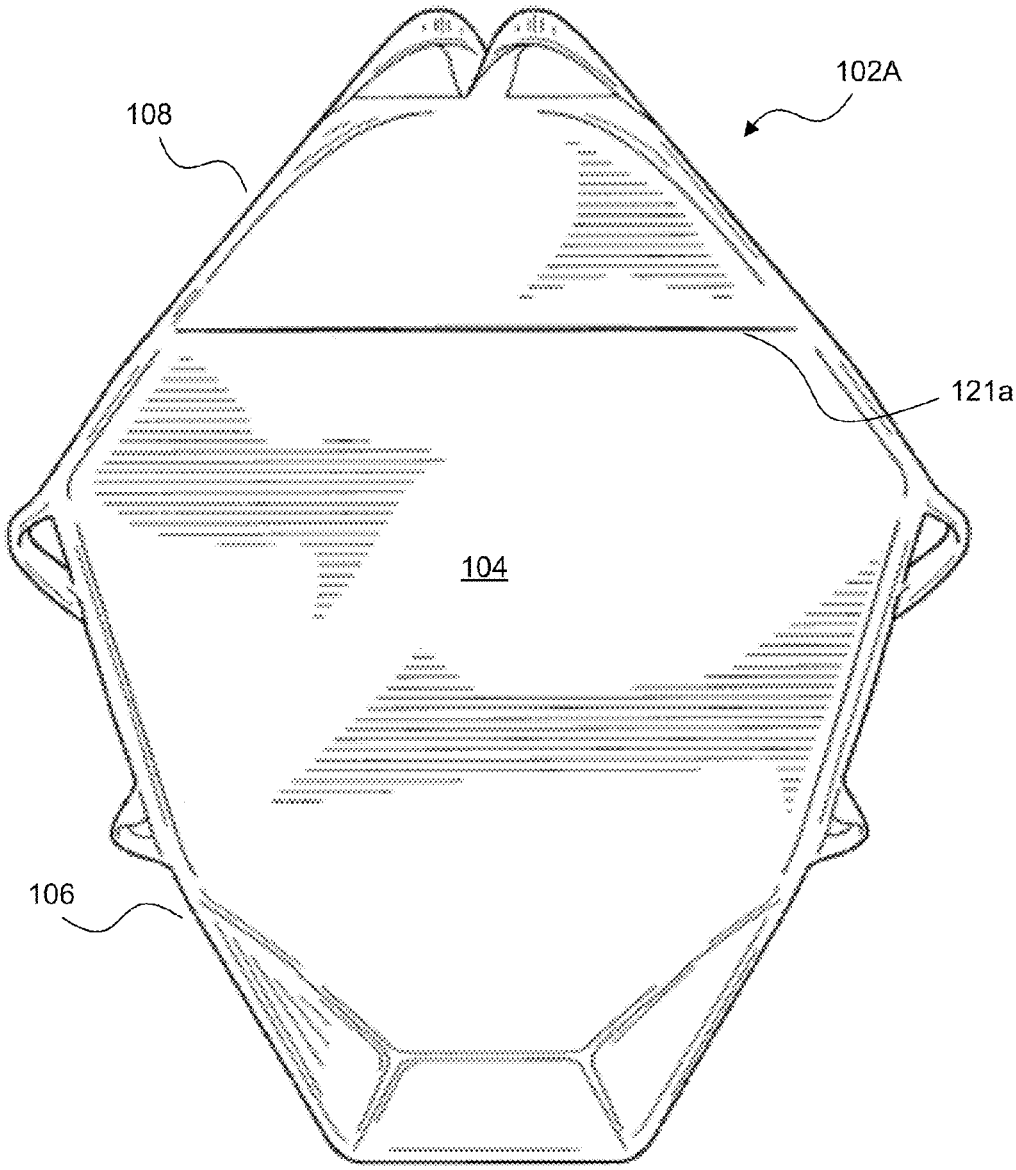
FIG. 2 shows a prospective view of the field stretcher embodiment of FIG. 1, showing the top surface thereof.
Figure 3:
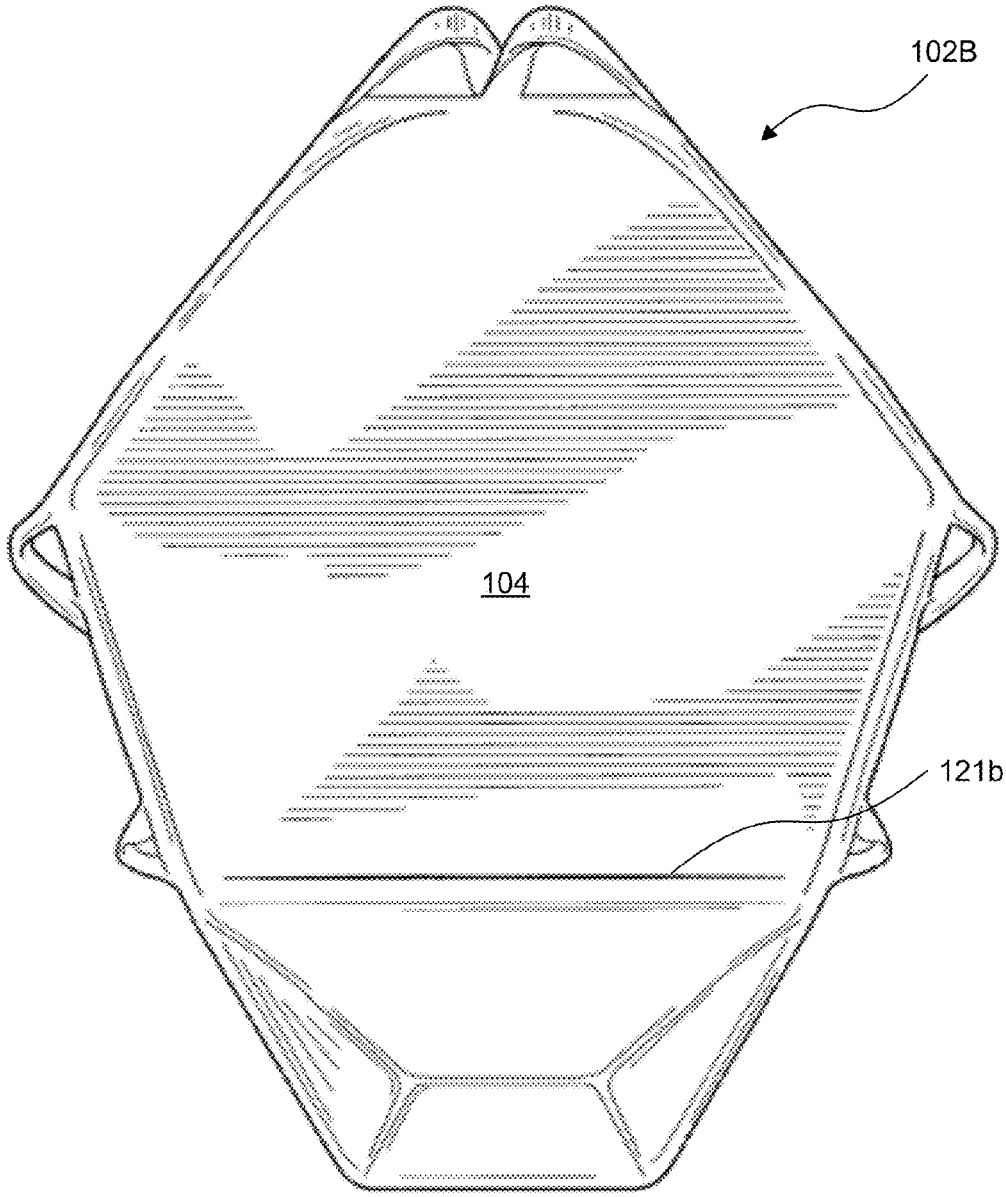
FIG. 3 shows a prospective view of an embodiment of the field stretcher of FIG. 1, showing the top surface thereof.
Figure 4:
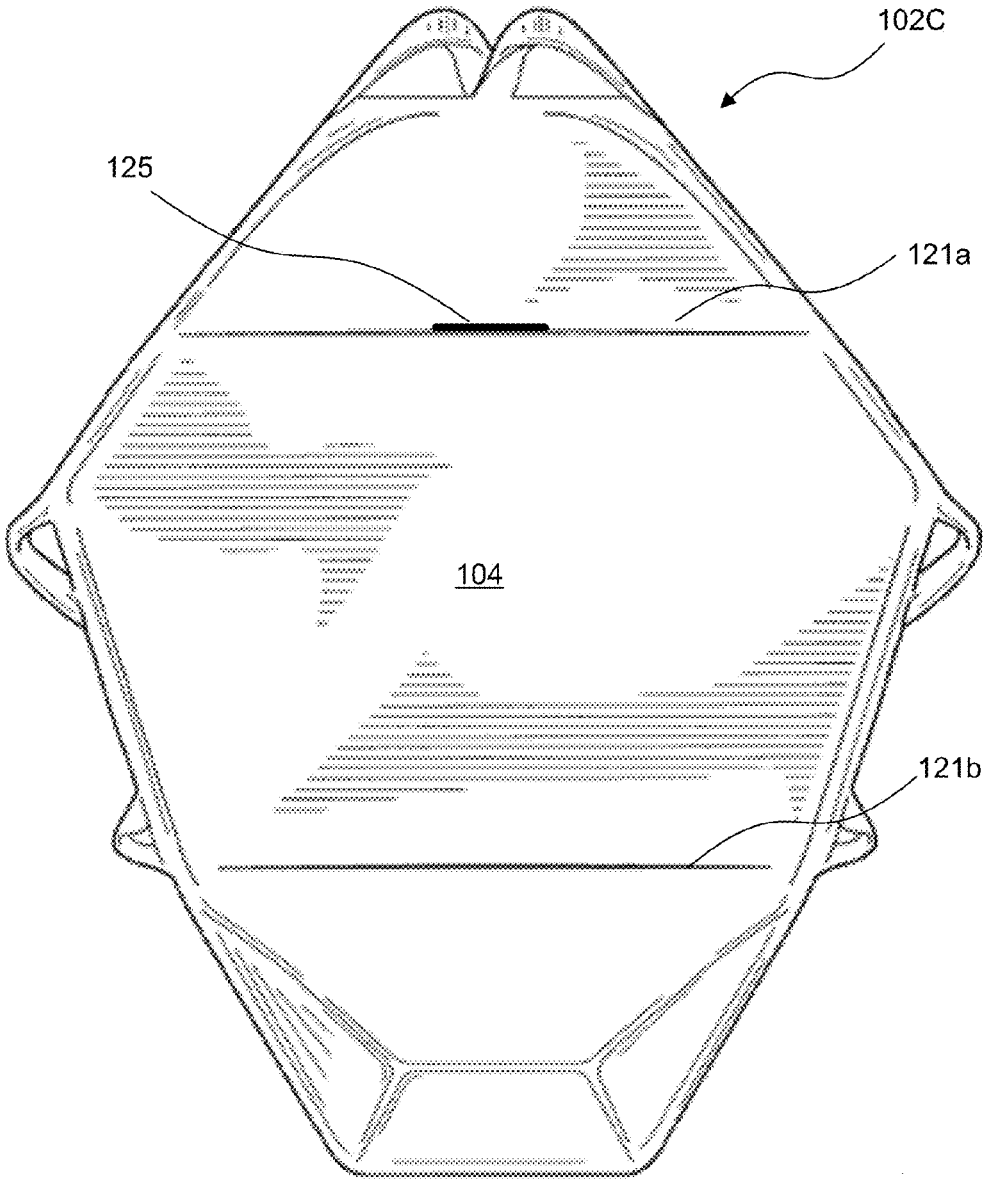
FIG. 4 shows a prospective view of an embodiment of the field stretcher of FIG. 1, showing the top surface thereof.

FIGS. 2-3 depict alternate arrangements of the slits in the field stretchers 102A, 102B, and 102C, for example, a single slit 121*a* in proximity to the head/shoulder region of a subject, a single slit 121*b* in proximity to the waist/leg region of a subject, and a combination of slits 121*a*, 121*b*, as above, in the upper skin of a dual skin field stretcher for providing compartments about the subject as further discussed below. FIG. 1 depicting surface 103 of the field stretcher, at least a portion thereof that contacts a surface (e.g., earth, concrete, carpet, vegetation, etc.) during transport is preferably of an anti-wear resistant material with anti-static, flame-retardancy, lubricity, or combinations of these properties, or may be a material surface treated to provide one or more of anti-wear resistance, anti-static, flame-retardancy, lubricity, or combinations thereof, to facilitate or improve the ability of the stretcher to transport across the surface or prevent or eliminate burning, ripping, or tearing of surface 103. The surface of subject transport portion 104, as shown in FIGS. 2-4, that contacts the subject may also be treated, for example, with an anti-infective, an anti-bacterial or combinations thereof.

Figure 5:
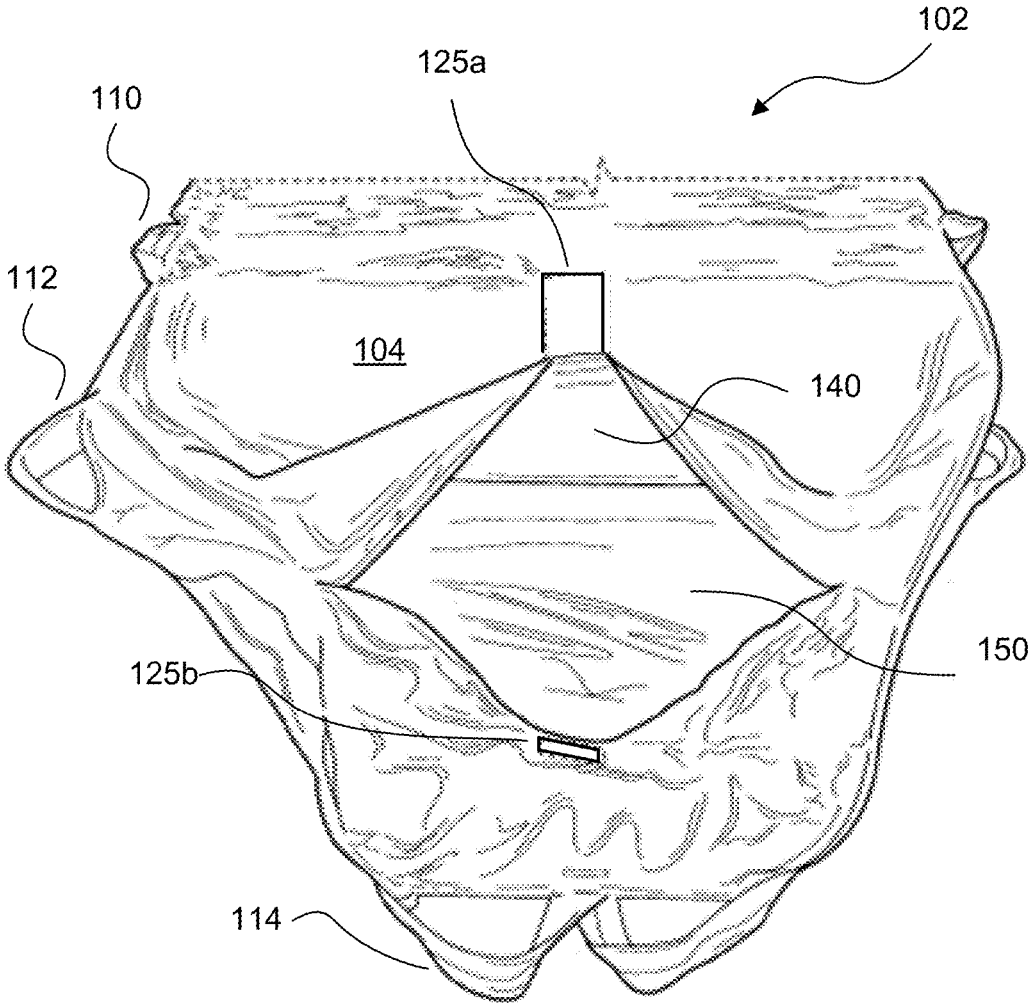
FIG. 5 shows a partial prospective end view of the field stretcher of FIG. 1, showing an accessible compartment therein.

Referring to FIG. 5, there is shown an accessible compartment 120 defined between the upper skin 140 and lower skin 150 of the dual skinned subject transporting portion 104 accessible via the lateral slit 121. Into this compartment may be inserted at least one pad (e.g., thermal pad, mattress, adsorbent pad, or other support structure) (not shown) to increase the comfort of a subject or provide some level of medical assistance to the subject situated thereon. Insertion of the pad (not shown) is made easier by accessing the compartment 120 via the longitudinal slit 123 and pulling the pad (not shown) down into the compartment 120. The pad may comprise an "instant heat" pak or similar thermally-actuated device to provide warmth, or the pad may be a combination of heating sources and supporting structure or absorbing material. The pad may be secured in place by securing means 125*a*, 125*b*, which may be one or more cooperative Velcro patches, buttons, snaps, latches, or similar fasteners. In another aspect, the personal belongings or severed parts of the subject may be contained in the compartment of the stretcher.

Figure 6:
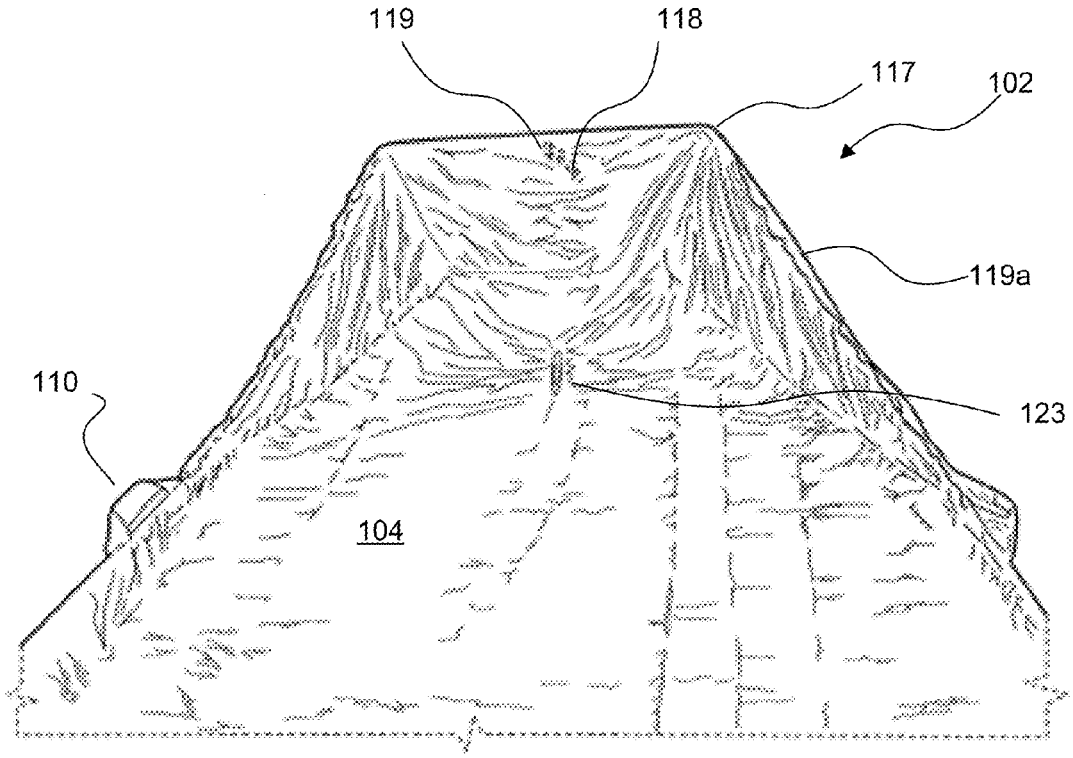
FIG. 6 shows a partial view of a lower section of the field stretcher of FIG. 1.

The lower region 106 comprises a generally upstanding covering portion 117, which can be seen in detail in FIG. 6. As the subject transporting portion 104 is formed from a fabric material, the upstanding covering portion 117 is shown as being folded essentially flat in FIGS. 2-4. Around the edge of the covering portion 117 and the lower region 106 of the subject transporting portion 104 is a drawstring 119 housed in lateral slit 121. The drawstring 119 threaded about the edge 119*a* of the lower region has a toggle 118 thereon situated halfway along the edge of the covering portion 117. Longitudinal slit 123 allows for the easy insertion of the pad (not shown) as shown and discussed above for FIG. 6.

Figure 7:
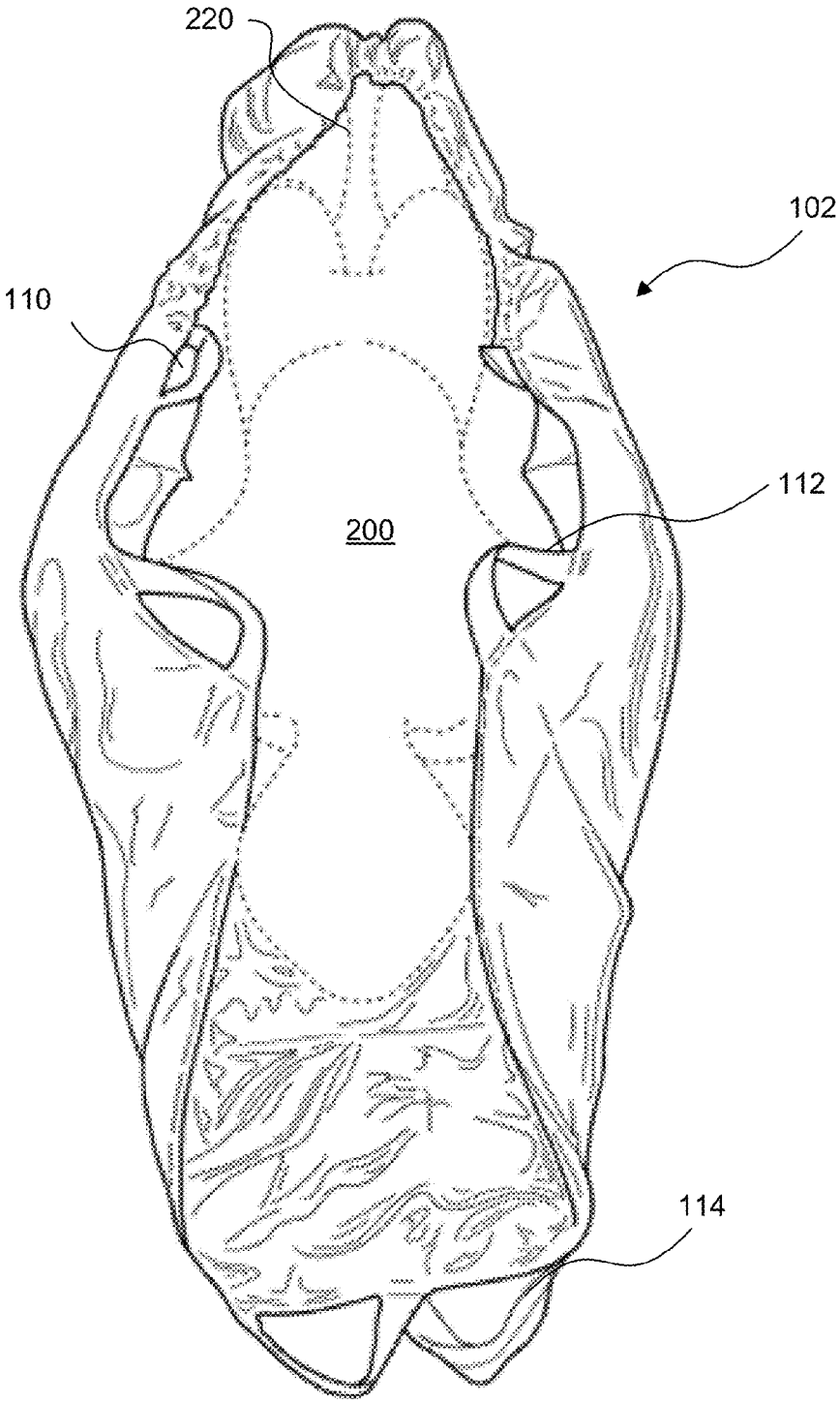
FIG. 7 shows a prospective view of the field stretcher of FIG. 1, including a subject thereon.

Referring to FIG. 7 there is shown a subject 200 situated on field stretcher 102. The sides of the stretcher 102 are depicted as pulled up over the sides of subject 200 and the covering portion 117 has been pulled up over the subject's lower torso. In this configuration the subject may be transported, for example, substantially horizontally.

Figure 8:
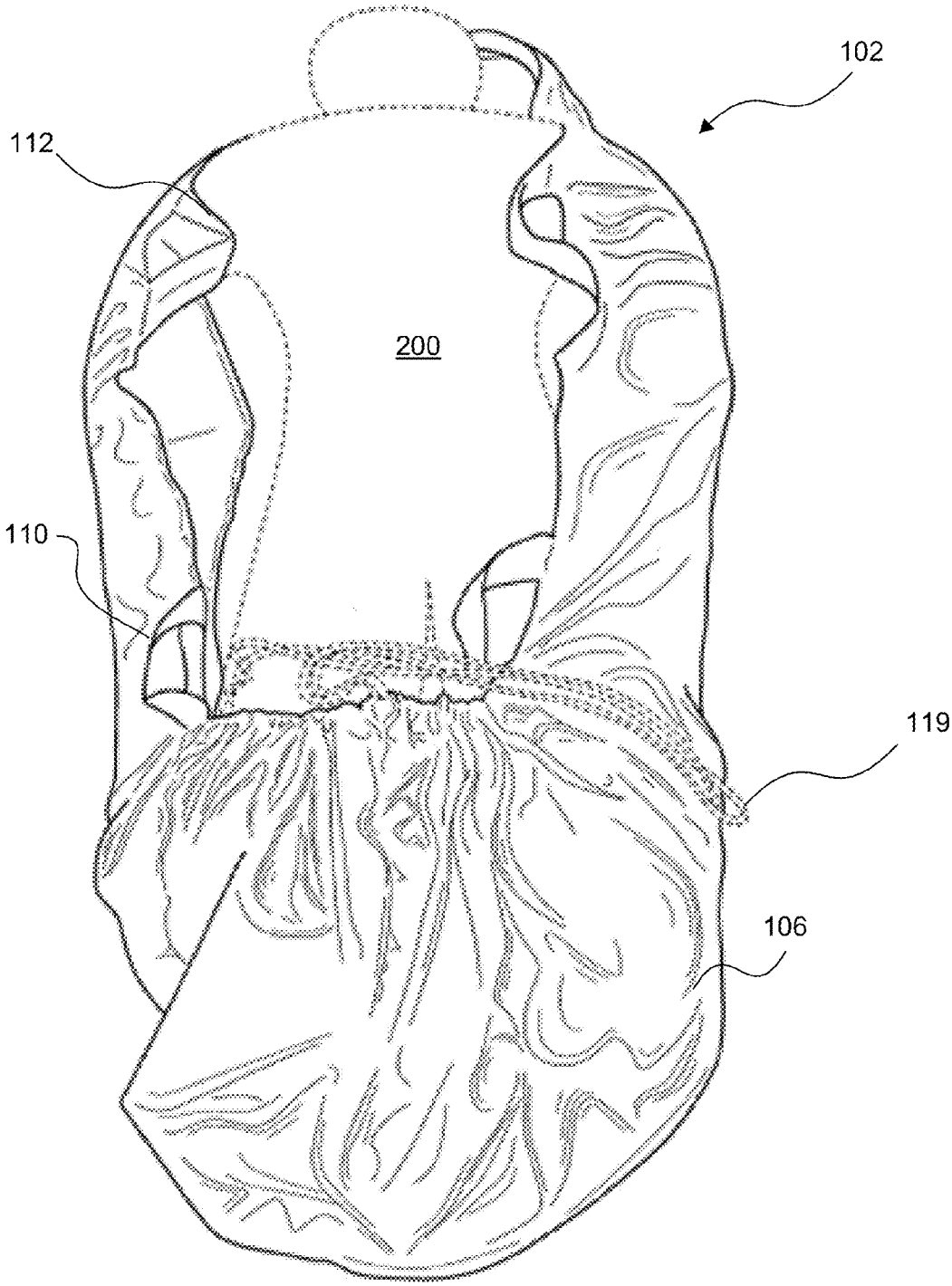
FIG. 8 shows a prospective view of the field stretcher of FIG. 1, depicted in a subject transporting configuration.
Figure 9:
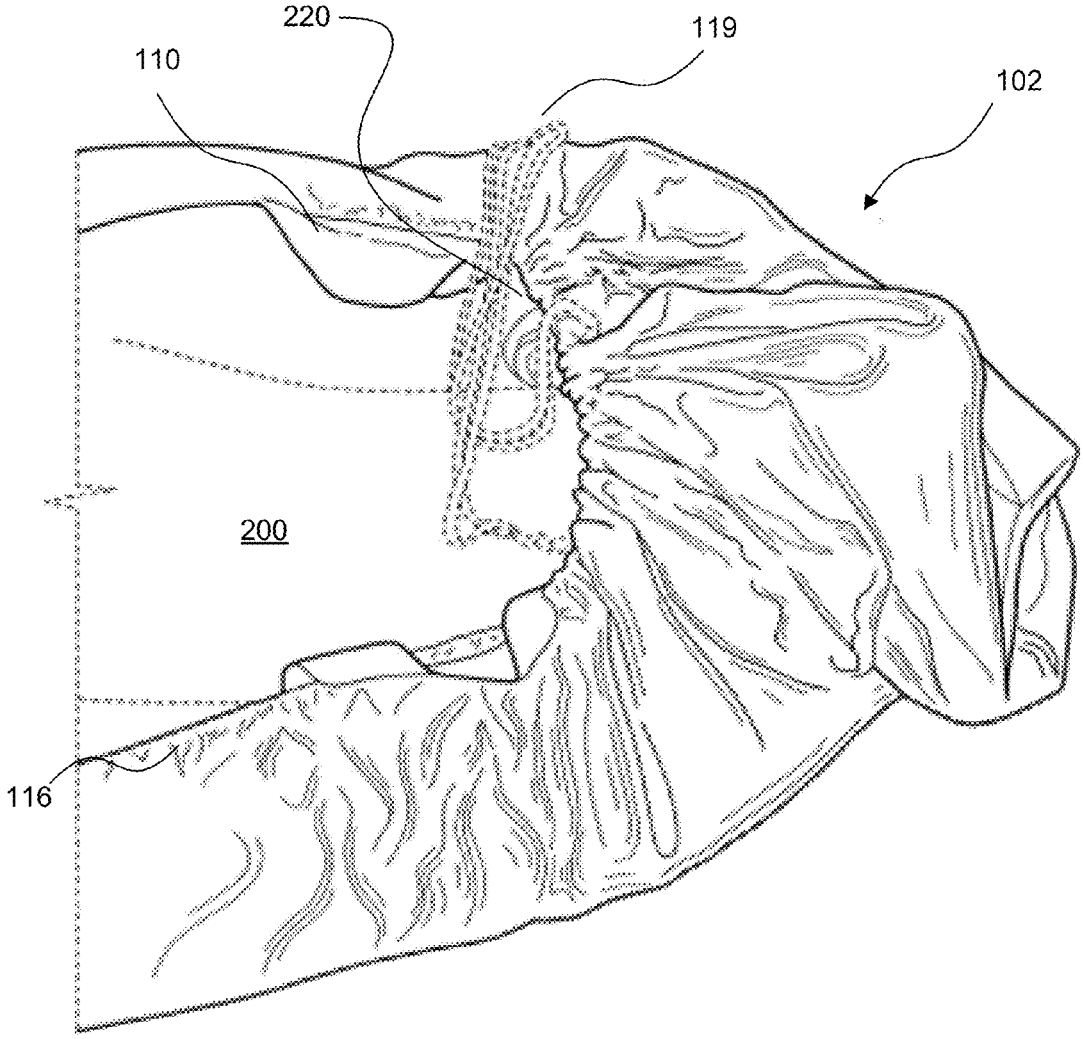
FIG. 9 shows a enlarged view of the lower portion of the field stretcher of FIG. 8, in a subject transporting configuration.

Referring now to FIGS. 8 and 9, stretcher 102 is shown having a subject 200 therein with the drawstring 119 drawn so that the lower end of the stretcher 102 (the covering portion 117 and the lower region 106 of the subject transporting portion 104) forms an accessible compartment 220 to retain the subject 200. This is provided, for example, by holding the toggle 118 and pulling the drawstring 119 therethrough. The toggle 118 serves to hold the drawstring 119 in the drawn configuration.

A field stretcher made in accordance with the present invention allows a subject to be retained within an accessible compartment 220 of the stretcher 102 and thus when transported, for example by dragging via handles 110, 112, 114, possibility of the subject rolling or sliding off the stretcher is prevented or eliminated. Also, as discussed above, in the theatre of war, soldiers often sustain major injuries to their feet and legs and, in severe cases, one or more of the legs may be removed by land mines. In such a scenario, the elongate extent of the field stretcher of the present invention can be significantly reduced to accommodate a person in this condition securely. The field stretcher disclosed and described, has the further advantage that the handles are situated at appropriate predetermined positions with regard to the subject, because the length of the stretcher 102 is adjustable to suit the subject, and in particular, a subject comprised by the loss of one or more lower appendages.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A field stretcher comprising a subject transporting portion, the subject transporting portion comprising an upper retaining region and a lower retaining region for retaining a subject positioned within the subject transporting portion, wherein only the lower retaining region of the subject transporting portion can be drawn together about a subject.

2. A field stretcher according to claim 1, further comprising one or more handles positioned about the subject transporting portion operable for dragging the stretcher along a surface.

3. A field stretcher according to claim 1, wherein the subject transporting portion generally corresponds in shape to a subject's body.

4. A field stretcher according to claim 1, wherein the subject transporting portion is of a generally elongate shape.

5. A field stretcher according to claim 1, wherein the subject transporting portion comprises one or more handles positioned at a predetermined position adjacent to the position of the head of a subject.

6. A field stretcher according to claim 1, wherein the subject transporting portion comprises one or more handles positioned along the sides thereof.

7. A field stretcher according to claim 1, wherein the subject transporting portion comprises means operable to draw a portion of the lower retaining region about a portion of a subject.

8. A field stretcher according to claim 7, wherein the means operable to draw a portion of the lower retaining region about a portion of the subject comprises a drawstring.

9. A field stretcher according to claim 8, wherein the drawstring extends around an edge of at least a section of the lower retaining region.

10. A field stretcher according to claim 1, wherein at least a portion of the subject transporting portion comprises a dual skin of material.

11. A field stretcher according to claim 10, wherein the subject transporting portion comprises a retaining compartment defined between portions of the dual skin of material.

12. A field stretcher according to claim 11, wherein the retaining compartment comprises a pad selected from a mattress pad, a heating pad, an absorbent pad, or combinations thereof.

13. A field stretcher according to claim 1, wherein at least a portion of the subject transporting portion comprises an abrasion resistant fabric, anti-static fabric, a flame-retardant fabric, or combinations thereof.

14. A field stretcher according to claim 1, wherein at least a portion of the subject transporting portion comprises an abrasion resistant coating, anti-static coating, a flame-retardant coating, or combinations thereof.

15. A field stretcher comprising a subject transporting portion, wherein at least a portion of the subject transporting portion comprises a dual skin of material;

a subject retaining compartment for retaining a subject positioned within the subject transporting portion;

means operable to draw a portion of the subject transporting portion about a portion of a subject;

one or more handles positioned at a predetermined position about the subject transporting portion; and a retaining compartment defined between portions of the dual skin of material, wherein the retaining compartment comprises a pad selected from a mattress pad, a heating pad, an absorbent pad, or combinations thereof wherein at least a portion of the subject transporting portion optionally comprises a fabric or a coating, the fabric or coating having the property of abrasion resistance, anti-static, flame-retardant, or combinations thereof.

16. A method of transporting a subject generally horizontally, the method comprising providing a field stretcher comprising a subject transporting portion comprising an upper retaining region and a lower retaining region;

positioning a subject in the subject transporting portion; and drawing only at least a portion of the lower retaining region about at least a portion of the subject.

17. The method of claim 16, wherein the field stretcher comprises means operable to draw the lower retaining region about a portion of a subject one or more handles positioned at a predetermined position about the subject transporting portion; and optionally, wherein at least a portion of the subject transporting portion comprises a fabric or a coating, the fabric or coating having the property of abrasion resistance, anti-static, flame-retardant, or combinations thereof.

18. The method of claim 16, wherein at least a portion of the subject transporting portion comprises a dual skin of material and a retaining compartment is defined between portions of the dual skin of material.

* * * * *